US012054946B2

(12) United States Patent
Zieta

(10) Patent No.: US 12,054,946 B2
(45) Date of Patent: Aug. 6, 2024

(54) I-PROFILE PREFORM AND AN I-PROFILE MANUFACTURING METHOD

(71) Applicant: INSTYTUT FORMY SP. Z O.O., Wroclaw (PL)

(72) Inventor: Oskar Zieta, Wroclaw (PL)

(73) Assignee: INSTYTUT FORMY SP. ZO.O ., Warsaw (PL)

( * ) Notice: Subject to any disclaimer, the term of this patent is extended or adjusted under 35 U.S.C. 154(b) by 169 days.

(21) Appl. No.: 17/778,246

(22) PCT Filed: Nov. 20, 2020

(86) PCT No.: PCT/IB2020/060965
§ 371 (c)(1),
(2) Date: May 19, 2022

(87) PCT Pub. No.: WO2021/100007
PCT Pub. Date: May 27, 2021

(65) Prior Publication Data

US 2023/0003023 A1 Jan. 5, 2023

(30) Foreign Application Priority Data

Nov. 20, 2019 (PL) ..... 431860

(51) Int. Cl.
*E04C 3/07* (2006.01)
*E04B 1/16* (2006.01)
(Continued)

(52) U.S. Cl.
CPC ..... *E04C 3/07* (2013.01); *E04B 1/169* (2013.01); *E04G 11/045* (2013.01); *E04C 2003/0452* (2013.01)

(58) Field of Classification Search
CPC .... E04B 1/169; E04C 3/07; E04C 2003/0452; E04C 2003/0456; E04G 11/045
(Continued)

(56) References Cited

U.S. PATENT DOCUMENTS 1,833,043 A * 11/1931 Sheldon ..... E04C 3/07 72/368
1,997,876 A * 4/1935 Sheldon ..... E04C 3/07 52/839
(Continued)

FOREIGN PATENT DOCUMENTS

CH 700604 A1 * 9/2010 ..... B21D 26/021
CN 112575958 A * 3/2021
(Continued)

OTHER PUBLICATIONS

International Search Report and Written Opinion of the International Search Authority, issued in PCT/IB2020/060965, mailed Mar. 11, 2021; ISA/EP.

*Primary Examiner* — Jessie T Fonseca
(74) *Attorney, Agent, or Firm* — Ralph E. Jocke; WALKER & JOCKE

(57) ABSTRACT

The object of the invention is an 1-profile preform which comprises an outer wall (1) of the first flange and two inner walls (2) of the first flange arranged with respect to the outer wall (1) of the first flange, a first web wall (3) and a second web wall (4) being arranged in a plane parallel with respect to the first web wall (3), an outer wall (5) of the second flange, and two inner walls (6) of the second flange arranged with respect to the outer wall (5) of the second flange, wherein the corresponding walls (1, 2, 3, 4, 5, 6) are arranged with respect to each other while retaining a gap forming a closed empty inner space of an 1-profile preform, and wherein a valve element (7) is arranged on at least one
(Continued)

Figure 1:
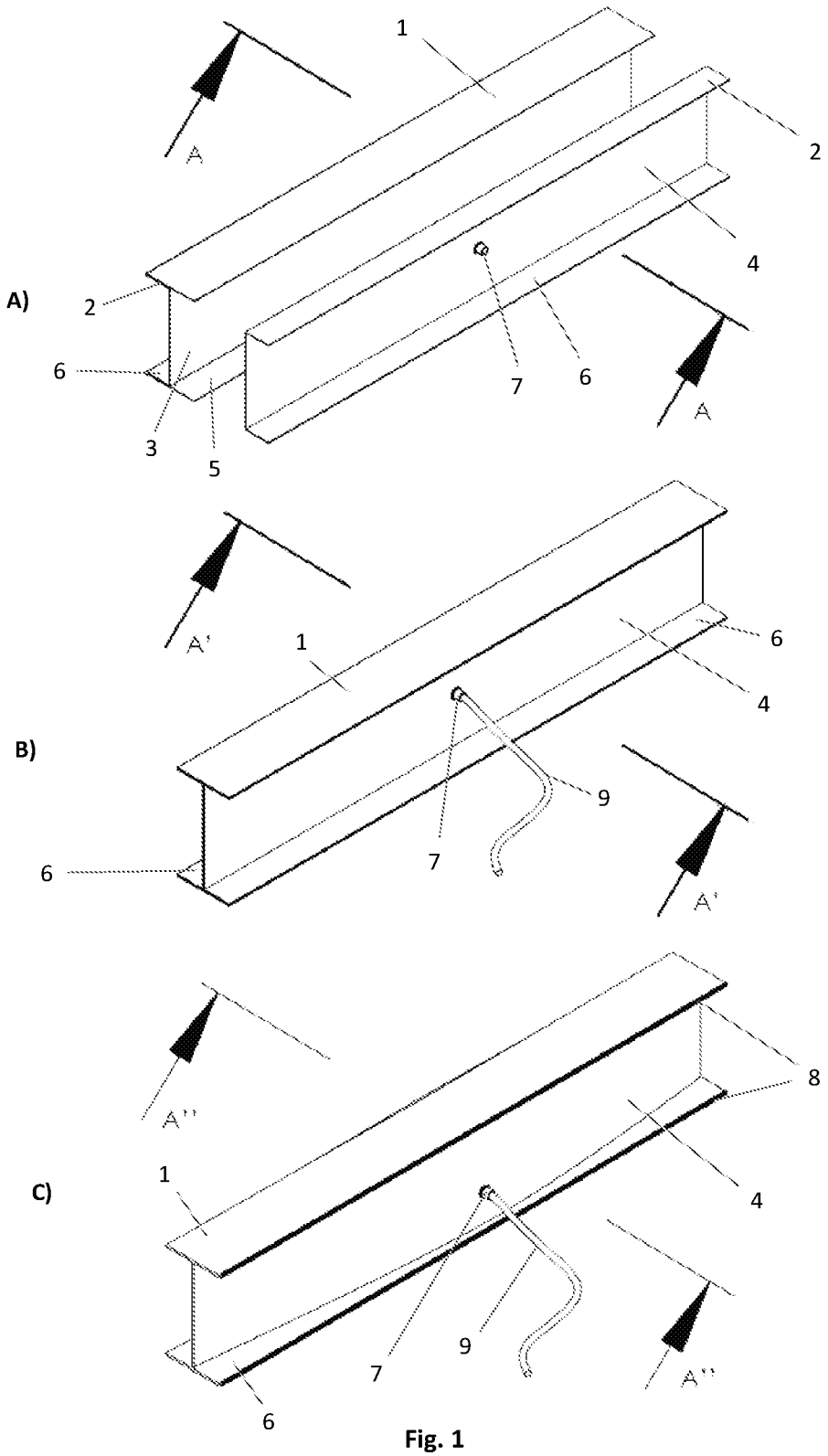

wall (1, 2, 3, 4, 5, 6). The object of the invention is also an 1-profile manufacturing method with the use of an 1-profile preform.

22 Claims, 7 Drawing Sheets

(51) Int. Cl.
*E04C 3/04* (2006.01)
*E04G 11/04* (2006.01)

(58) Field of Classification Search
USPC ..... 52/2.15, 2.21, 2.22
See application file for complete search history.

(56) References Cited

U.S. PATENT DOCUMENTS 2,098,676 A * 11/1937 Rafter ..... E04C 3/09 52/842
2,122,698 A * 7/1938 Rafter ..... E04C 3/09 52/636
2,129,624 A * 9/1938 Rafter ..... E04C 3/292 52/636
2,685,354 A * 8/1954 Collins ..... E04C 3/07 105/422
3,798,867 A 3/1974 Starling
4,019,301 A 4/1977 Fox
5,556,565 A 9/1996 Kirkwood et al.
8,161,687 B2 * 4/2012 Crettol ..... E04C 3/005 52/2.13
10,597,864 B1 * 3/2020 Pearson ..... E04B 5/40
11,459,755 B2 * 10/2022 Strickland ..... E04B 5/04
2006/0070340 A1 * 4/2006 Fanucci ..... E04C 3/29 52/837
2011/0247297 A1 * 10/2011 Bae ..... E04C 3/291 52/846
2021/0301530 A1 * 9/2021 Faridnia ..... E04C 5/0609

FOREIGN PATENT DOCUMENTS

DE 10249601 B3 * 5/2004 ..... B21D 26/02
DE 102013109790 A1 * 3/2015 ..... E04C 3/07
EP 2110189 A1 * 10/2009 ..... B21D 26/00
KR 20150002377 A * 1/2015
PL 206365 B1 7/2010
PL 65088 Y1 8/2010
PL 213146 B1 1/2013
WO WO-0132999 A1 * 5/2001 ..... E04C 3/07

* cited by examiner

I-PROFILE PREFORM AND AN I-PROFILE MANUFACTURING METHOD

CROSS-REFERENCE TO RELATED APPLICATIONS

This application is a 371 U.S. National Phase of International Application No. PCT/IB2020/060965, filed Nov. 20, 2020, which claims priority to Polish Application No. P.431860 filed Nov. 20, 2019. The entire disclosures of the above applications are incorporated herein by reference.

The objects of the invention are an I-profile manufacturing method and an I-profile preform. The objects of the invention are applied in construction, for manufacturing load-bearing structures, for example walls, floors and ceilings, as well as in engineering or in metalworking.

I-profiles are among sections most often used in construction. They are particularly useful in forming key-importance structural parts, such as pillars, beams or truss members. I-profiles owe their name to a characteristic cross-section, which resembles two connected letters T. I-profiles consist of two flanges and the so-called web, which connects the flanges. There is available a wide range of I-profiles having various parameters and intended for a number of different applications, such as standard (INP), parallel (IPE), or wide-flange (HEB, HEA) I-profiles.

Utility model PL65088Y1 discloses an I-bar which consists of two flanges connected with a web, wherein the thickness of the second flange is smaller than the thickness of the first flange and preferably is from 0.75 to 0.95 of the thickness of the first flange. Such an I-bar having flanges of two different thicknesses is used as a track for an overhead rail system.

Polish patent PL206365B1 discloses a manufacturing method for an I-section which is used in the production of I-profiles being elements of civil-engineering structures, especially of buildings and houses. In the manufacturing method for an I-section, a metal sheet having a width equal to the sum of the web width and the double width of both flanges is bent in opposite directions on the two sides at a 90° angle along the two edges which form the contour of the web, and subsequently the sheet is bent at a 180° angle along the first edge line of each flange, and then the sheet is bent at a 180° angle along the second edge line of each flange in the direction of the inner space of the section.

Another Polish patent PL213146B1 discloses a method for manufacturing an I-section with sandwich flanges. In the method for manufacturing an I-section with sandwich flanges by bending a metal sheet known from patent PL213146B1, the metal sheet, having a width equal to the sum of the web width, four times the width of and double the thickness of both flanges, is bent on the two sides at a 90° angle of the two edges which form the contour of the web, and subsequently the sheet is bent at a 90° angle along the first edge line, and then the sheet is bent at a 90° angle along the second edge line, and further the sheet is bent at a 90° angle along the third edge line, and then the sheet is bent at a 90° angle along the fourth edge line, and finally the sheet is bent on the two sides at a 90° angle of the two edges which form the contour of the web. The space in the flanges is filled with a filler, particularly in the form of metal foam.

The technical problem of the present invention is to provide such a method for manufacturing an I-profile which will allow the manufacturing of an I-profile having desired properties, in particular with respect to the strength and the stiffness coefficient of the I-profile and to the load-bearing capacity to weight ratio, while maintaining high dimensional accuracy. It is desirable that the I-profile manufacturing method has a limited number of technological steps and is realized without the use of specialist and complicated apparatus, so as to directly provide economic benefits of a simplified, less time-consuming and thus cheaper I-profile manufacturing process. It is also desirable that the I-profile manufacturing method is of low material-consumption and allows the I-profile to be manufactured from adjusted materials having a wide range of geometrical parameters, and in particular to have different web heights and different flange widths both symmetrical and asymmetrical. It is also important to provide an I-profile manufacturing method which would allow the shape of the I-profile to be easily modified within a wide range of geometrical parameters and without the need to rearrange the apparatus used in the manufacturing process. Another technical problem of the present invention is to provide an I-profile preform which will be useful in the said I-profile manufacturing method and will provide an I-profile having desired technical parameters.

The first object of the invention is an I-profile preform characterized in that it comprises an outer wall of the first flange and two inner walls of the first flange arranged with respect to the outer wall of the first flange, a first web wall and a second web wall being arranged in a plane parallel with respect to the first web wall, an outer wall of the second flange, and two inner walls of the second flange arranged with respect to the outer wall of the second flange, wherein the corresponding walls are arranged with respect to each other while retaining a gap forming a closed empty inner space of an I-profile preform, and wherein a valve element is arranged on at least one wall.

In a preferred embodiment of the invention, the two inner walls of the first flange are arranged in the first plane parallel with respect to the outer wall of the first flange.

In another preferred embodiment of the invention, the two inner walls of the first flange are arranged in the first plane parallel with respect to the outer wall of the second flange.

In another preferred embodiment of the invention, the outer wall of the first flange, the first inner wall of the first flange, the first web wall, the first inner wall of the second flange, and the outer wall of the second flange are formed of one sheet of material, forming an E-profile, while the second inner wall of the first flange, the second web wall, and the second inner wall of the second flange are formed of one sheet of material, forming a C-profile.

Preferably, the first inner wall of the first flange, the first web wall, the first inner wall of the second flange, the outer wall of the second flange, the second inner wall of the second flange, the second web wall and the second inner wall of the first flange are formed of one sheet of material, forming an incomplete intermediate I-profile.

Also preferably, the first inner wall of the first flange, the first web wall, and the first inner wall of the second flange are formed of one sheet of material, forming a C-profile, and/or the second inner wall of the second flange, the second web wall, and the second inner wall of the first flange are formed of one sheet of material, forming a C-profile.

In a preferred embodiment of the invention, all of the walls are formed of one sheet of material, forming a complete intermediate I-profile.

In another preferred embodiment of the invention, the outer wall of the first flange and/or the outer wall of the second flange are formed of a flat bar.

In a further preferred embodiment of the invention, the walls forming the first flange and/or the second flange contract in the longitudinal direction, define a barrel shape or define an hourglass shape.

Preferably, the unconnected wall edges are sealed with a seal, forming a closed hermetic empty inner space of the I-profile preform.

Also preferably, the seal is a fusion weld, a pressure weld, a layer of adhesive or a lap joint.

In a preferred embodiment of the invention, the first flange has a different width than the second flange.

In another preferred embodiment of the invention, the valve element is a pneumatic or hydraulic connection.

In a further preferred embodiment of the invention, the valve element is arranged on the first web wall or on the second web wall.

The second object of the invention is an I-profile manufacturing method characterized in that it comprises the following steps:

a) an I-profile preform, as defined in the first object of the invention, is provided,
b) the unconnected wall edges are sealed with a seal for forming a closed hermetic empty inner space of the I-profile preform,
c) a source of fluid under pressure is connected to the valve element,
d) an I-profile preform is inserted between pressure plates, so that the pressure plates are in contact with the flanges of the I-profile preform,
e) fluid under pressure is introduced into the inner space of the I-profile preform.

In a preferred embodiment of the invention, step b) is realized by fusion welding, pressure welding, gluing or crimping. In the case of fusion welding, any technology deemed appropriate for the purpose, including TIG, MIG, MAG, CMT, or laser technology, can be used.

In another preferred embodiment of the invention, the fluid is air, machine oil, water, fluid concrete or fluid plastic, in particular a one-, two- or three-component foam, for example a flex 140 type. In particular, the fluid concrete can be concrete reinforced with polypropylene fibers, glass fibers, carbon fibers or steel fibers.

In another preferred embodiment of the invention, during step d) a force is applied to the pressure plates in the direction of the I-profile preform.

Preferably, step e) is realized in room temperature or in a high-temperature process.

Also preferably, the pressure of the fluid introduced into the I-profile preform is 5 bars.

More preferably, in step e) a fluid under pressure is introduced into the inner space of the I-profile preform for 1 minute, and subsequently a constant pressure is maintained in the I-profile preform for 30 seconds.

An I-profile manufacturing method according to the invention with the use of an I-profile preform according to the invention allows the manufacturing of an I-profile having desired properties, in particular with respect to the stiffness coefficient and torsional strength of the I-profile, as well as the load-bearing capacity to weight ratio. In particular, owing to the use of I-profile preforms manufactured largely from a relatively thin metal sheet, the I-profile manufactured with the method according to the invention allows a significantly increased load-bearing capacity to profile weight ratio in comparison to classic solutions known in the art. In addition, owing to the use of thicker flat bars as the outer walls of the first and/or second flange of the I-profile preform, it is possible to manufacture an I-profile having improved usefulness in these areas. Furthermore, the I-profile manufacturing method according to the invention is realized with the use of uncomplicated machinery park, which translates into economic benefits and a significantly simplified manufacturing process of the I-profile. A small number of seals improves the speed and lowers the labor-intensity of the I-profile manufacturing process. In addition, the I-profile manufacturing based on introducing pressurized fluid into the hermetic inner space of the I-profile preform allows the parameters of the manufactured I-profile to be modified within a wide range, in particular with respect to its final geometry.

Figure 2:
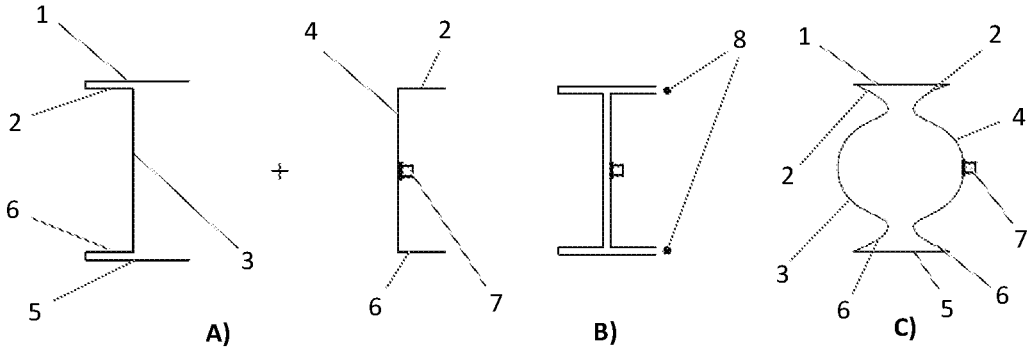
Figure 3:
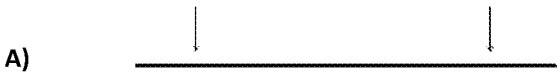
Figure 3:
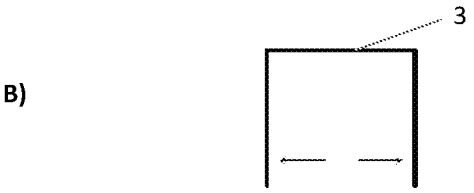
Figure 3:
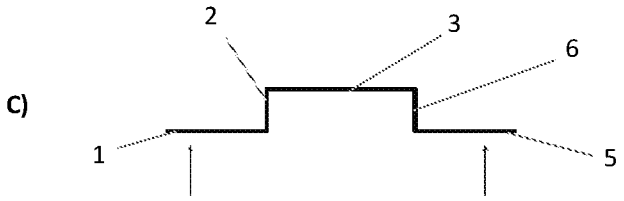
Figure 3:
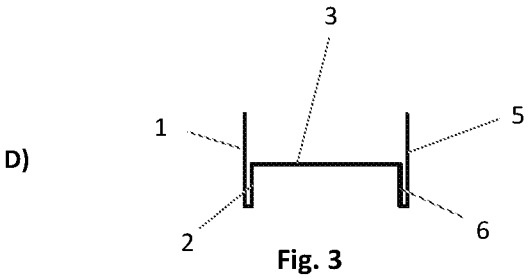
Figure 4:
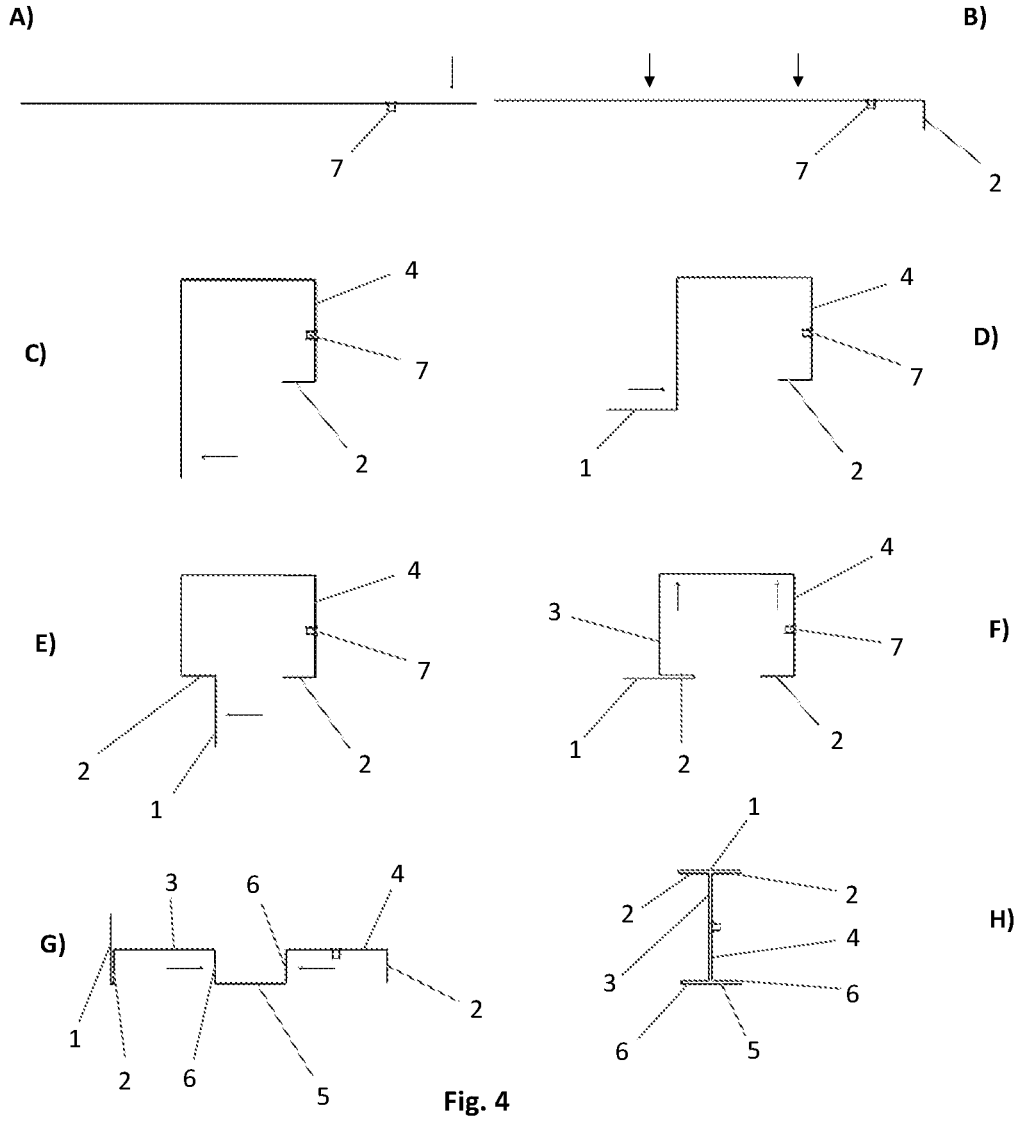
Figure 5:
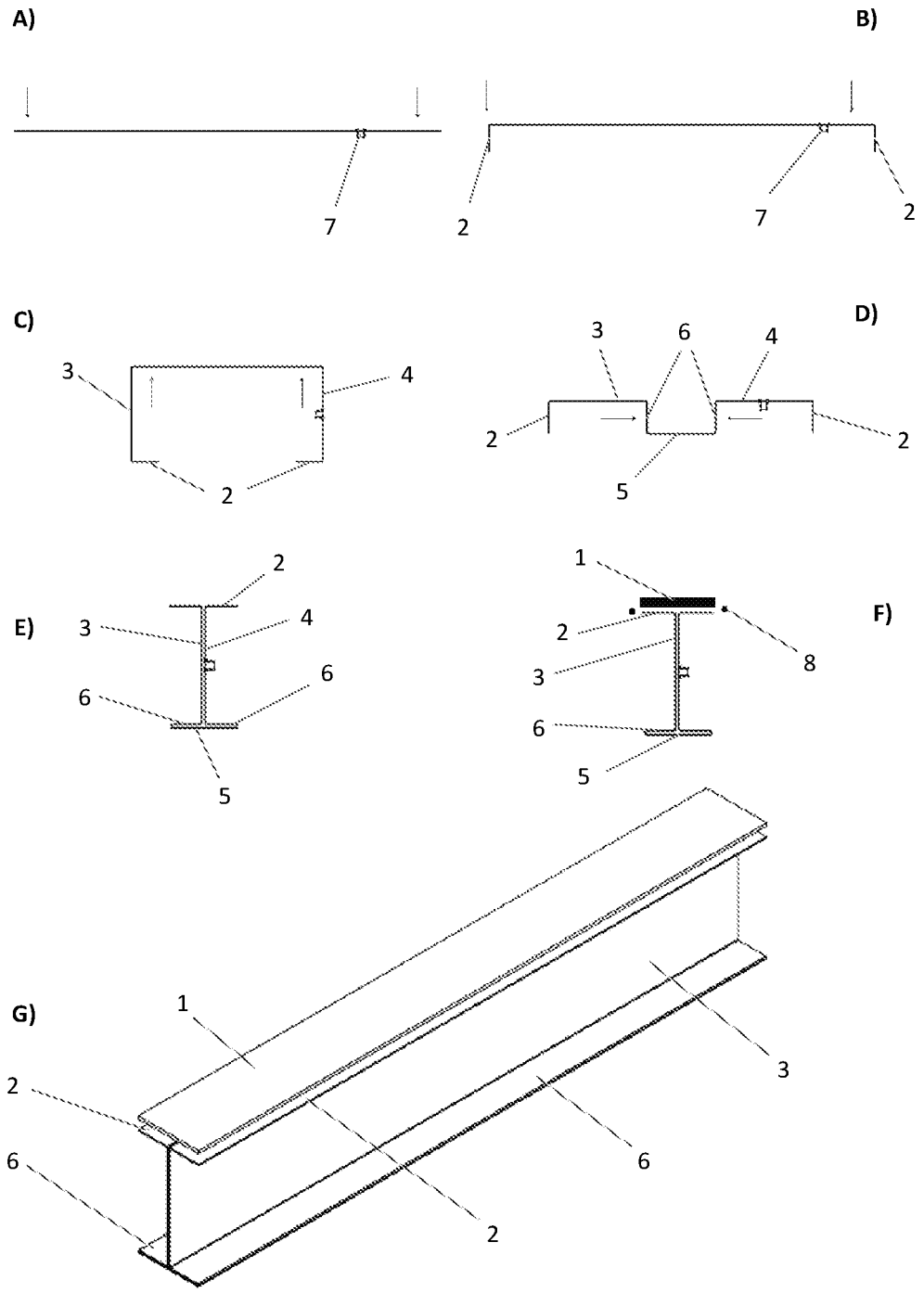
Figure 6:
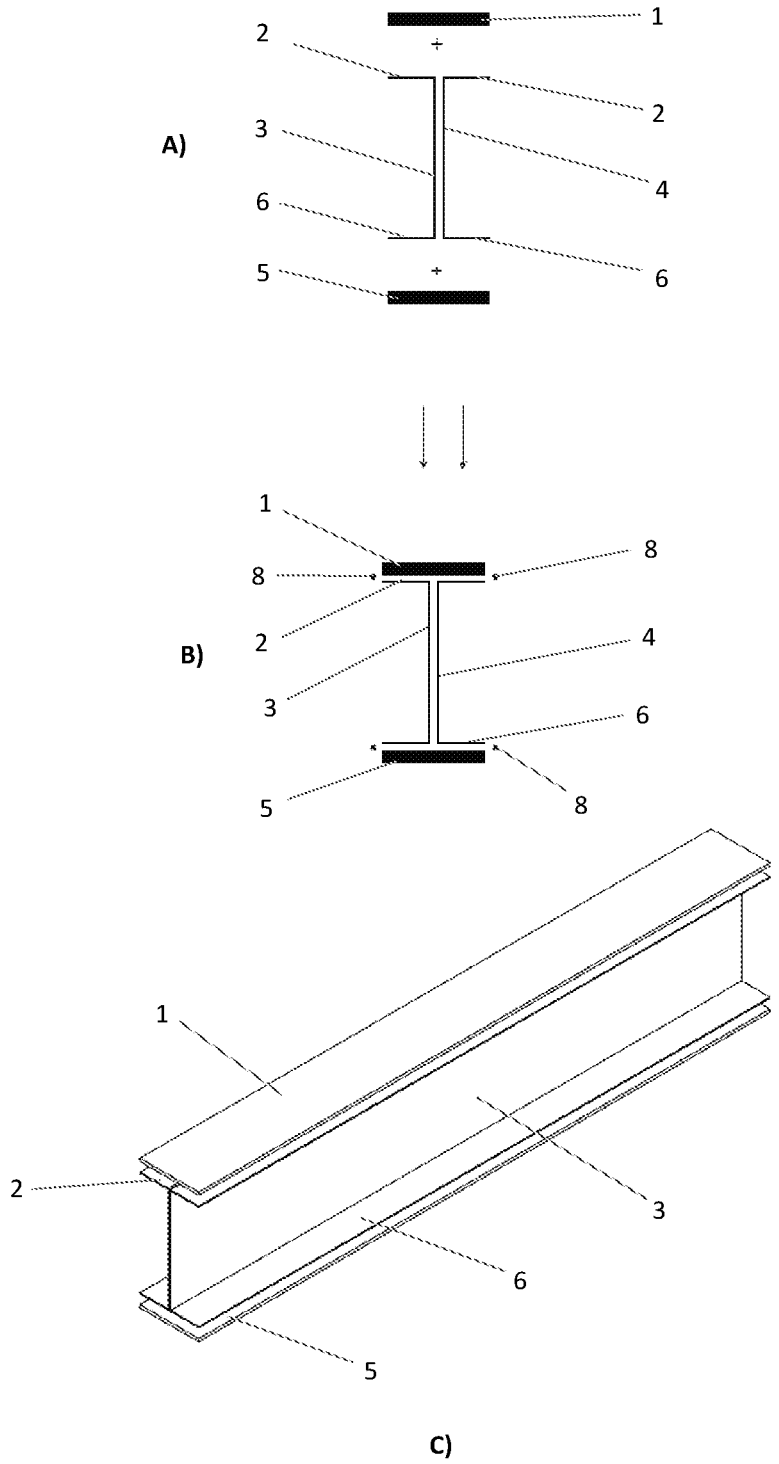
Figure 7:
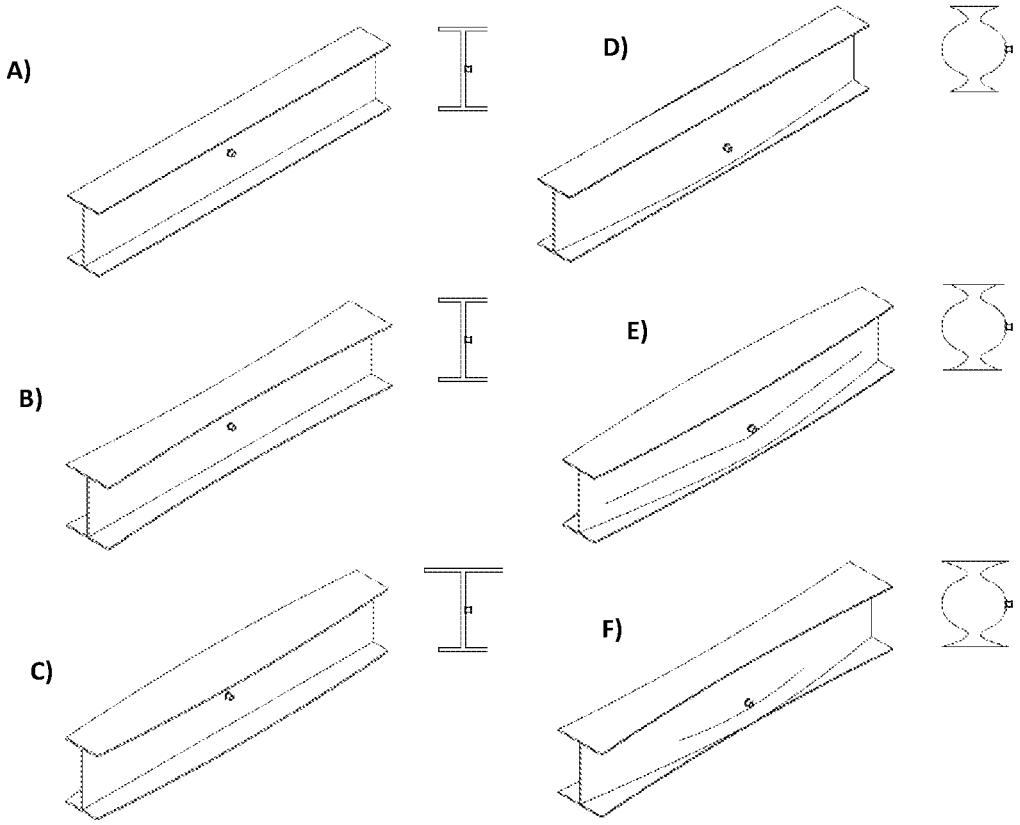
Figure 8:
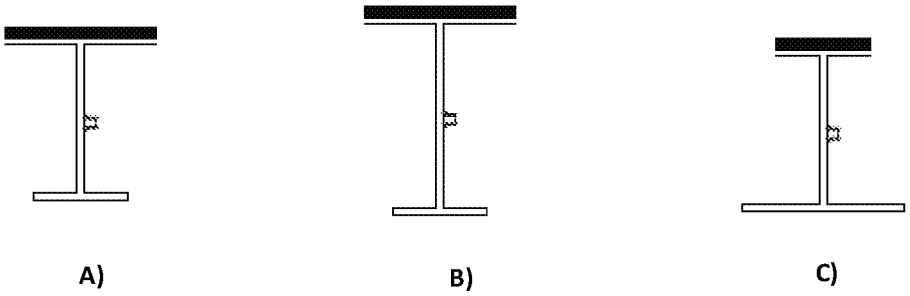
Figure 9:
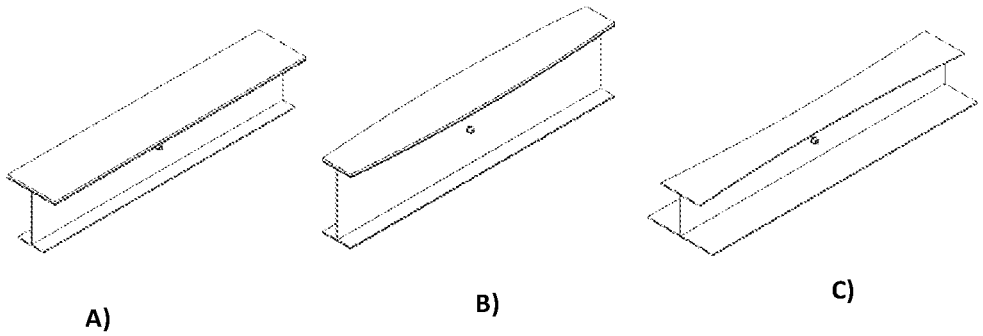
Figure 10:
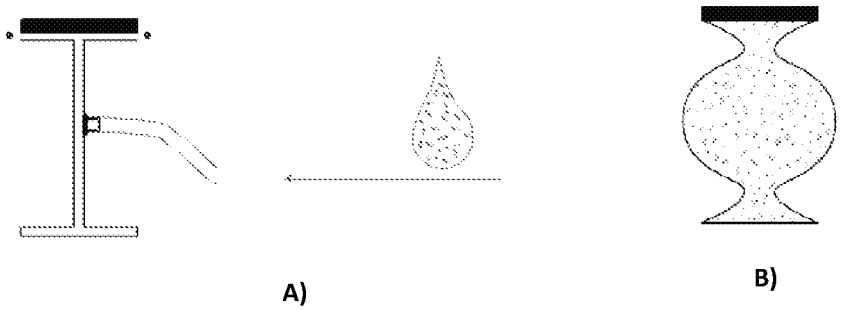
Figure 11:
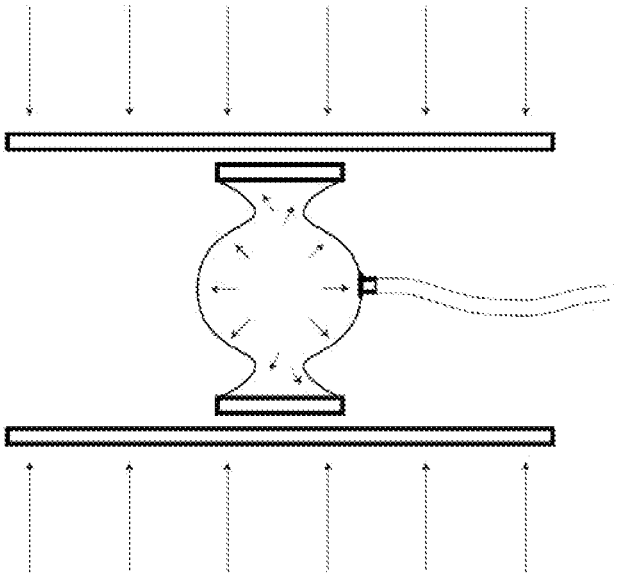

The solution according to the present invention has been shown in the embodiments below and illustrated in the drawing, in which:

FIG. 1A-C is an axonometric view of the subsequent steps of the I-profile manufacturing method according to an embodiment of the invention, FIG. 2A-C is a cross-sectional view of the subsequent steps of the I-profile manufacturing method of FIG. 1A-C, FIG. 3A-D is a cross-sectional view of the subsequent steps of manufacturing one part of the I-profile preform according to an embodiment of the invention, FIG. 4A-H is a cross-sectional view of the subsequent steps of manufacturing the I-profile preform according to another embodiment of the invention, FIG. 5A-F is a cross-sectional view of the subsequent steps of manufacturing the I-profile preform according to a further embodiment of the invention, FIG. 5G is an axonometric view of the I-profile preform manufactured in the steps shown in FIG. 5A-F, FIG. 6A-B is a cross-sectional view of the subsequent steps of manufacturing the I-profile preform according to a yet further embodiment of the invention, FIG. 6C is an axonometric view of the I-profile preform manufactured in the steps shown in FIG. 6A-B, FIG. 7A-F is an axonometric view and a cross-sectional view of further embodiments of the I-profile preform and also the respective I-profiles manufactured from the I-profile preforms, FIG. 8A-C is a cross-sectional view of further embodiments of the I-profile preform, FIG. 9A-C is an axonometric view of still further embodiments of the I-profile preform, FIG. 10A-B is a cross-sectional view of the subsequent steps of the I-profile manufacturing method according to a further embodiment of the invention, FIG. 11 shows one of the manufacturing steps of an I-profile according to one embodiment of the invention.

EMBODIMENT 1

The I-profile manufacturing method according to the first embodiment of the invention is schematically shown in FIG. 1A-C and in FIG. 2A-C. The presented embodiment of the I-profile manufacturing method is based on an I-profile preform according to one of the possible embodiments of the invention, without being a limitation to the scope of the present invention. In alternative embodiments of the I-profile manufacturing method according to the invention, it is possible to use a different I-profile preform, in particular an I-profile preform shown in further embodiments of the invention.

Generally, the I-profile manufacturing method comprises a step of providing an I-profile preform (axonometric view in FIG. 1A and a cross-sectional view along plane A-A in FIG. 2A). As shown in FIGS. 1A and 1*n* FIG. 2A, the preform comprises an outer wall 1 of the first flange and two inner walls 2 of the first flange arranged in one plane, parallel with respect to the outer wall 1 of the first flange, a first web wall 3 and a second web wall 4 arranged in a plane parallel with respect to the first web wall 3, an outer wall 5 of the second flange and two inner walls 6 of the second flange arranged in one plane parallel with respect to the outer wall 5 of the second flange, wherein the corresponding walls, i.e. the outer wall 1 of the first flange with two inner walls 2 of the first flange and the first web wall 3 with the second web wall 4, as well as the outer wall 5 of the second flange with two inner walls 6 of the second flange, are arranged with respect to each other while retaining a gap forming a closed empty inner space of an I-profile preform.

In this embodiment, the I-profile preform is formed of two separate profiles appropriately bent from a metal sheet and forming an E-profile and a C-profile, wherein the web height of the E-profile is substantially corresponding to the web height of the C-profile. The E-profile comprises an outer wall 1 of the first flange, the first inner wall 2 of the first flange, the first web wall 3, the first inner wall 6 of the second flange and the outer wall 5 of the second flange of the I-profile preform. The C-profile, on the other hand, comprises the second inner wall 2 of the first flange, the second web wall 4 and the second inner wall 6 of the second flange of the I-profile preform.

The E-profile and the C-profile are formed of a cold-bent metal sheet, the subsequent E-profile manufacturing steps being schematically shown in FIG. 3A-D. In particular, the preparation of the E-profile starts with providing a metal sheet of appropriate dimensions (FIG. 3A), the width of the metal sheet corresponding to the sum of the lengths of all sides forming the E-profile. Subsequently, the metal sheet is bent inwards along two parallel bending lines at an angle of 90°, in the locations indicated with the arrows, thus forming the web of the E-profile between the bent parts, corresponding to the first web wall 3 of the I-profile preform (see FIG. 3B). In the next step of bending the E-profile, the metal sheet is bent in the parts extending in parallel to each other, in locations indicated with the arrows in FIG. 3B, at an angle of 90°, in the direction away from each other (see FIG. 3C). The length between the last bend and the adjacent previous bend corresponds to half the length of the E-profile flange (on condition that the E-profile flanges have lengths symmetrical with respect to the web) and is the first inner wall 2 of the first flange and the first inner wall 6 of the second flange of the I-profile preform. In the subsequent step, the parts of the metal sheet extending outwards are bent by further 90° in a direction consistent with the previous bend, forming a lap which is half of the formed E-profile flange, wherein the bent sections of the metal sheet form the outer wall 1 of the first flange and the inner wall 5 of the second flange of the I-profile preform (as shown in FIG. 3D).

Returning to FIG. 1A and FIG. 2A, the E-profile thus formed is matched with the C-profile in such a way that the webs of the corresponding E and C profiles, i.e. the first web wall 3 and the second web wall 4 of the I-profile preform extend in parallel to each other, while the E-profile flanges and the C-profile flanges form the I-profile preform, which is formed of a metal sheet on the outer surface, while retaining a gap inside the I-profile preform, i.e. a small distance between the adjacent walls of the elements of the I-profile preform. The C-profile is also formed of a metal sheet, although the C-profile manufacturing method has not been shown in detail due to the fact that the metal sheet only requires the repeating of the step shown in FIG. 3A. Importantly, the C-profile is provided with a valve element 7, preferably in the middle of the metal sheet of which the C-profile is formed. The valve element 7 is a pneumatic or hydraulic connection and allows a leakproof fastening of a supply duct 9 from an external source of pressurized fluid. In some embodiments of the invention, the valve element 7 may be a valve, particularly a non-return valve. The location of the valve element 7 is not a limitation to the scope of the present invention, and in alternative embodiments the valve element 7 may be arranged in any location on the metal sheet of both the E-profile and the C-profile (or of any wall 1, 2, 3, 4, 5, 6 in other embodiments), on condition that it allows a connection with the inner space of the I-profile preform.

FIG. 1B and FIG. 2B show the E-profile and the C-profile matched with each other. In the next step of the I-profile manufacturing method, the I-profile preform is sealed for creating a sealed hermetic inner space. The sealing is performed on the edges of the metal sheet forming the E-profile and the C-profile after the profiles have been matched with each other. In this embodiment, the sealing is therefore performed on the longitudinal edges of the E and C profiles matched with each other, as schematically shown in FIG. 2B. In this embodiment, the sealing was performed by means of welding the corresponding edges together, forming inter alia longitudinal welds constituting the seal 8. The sealing is moreover performed on the edges of the E and C profiles matched with each other, on the front and on the back of the I-profile preform. By sealing all of the above-listed edges, a leakproof hermetic inner space is formed in the I-profile preform, as schematically shown in the cross-section of FIG. 2B. The type of seal 8 is in this case not a limitation to the scope of the invention, and it is possible in alternative embodiments to use any type of seal 8, on condition that a leakproof inner space is formed in the I-profile preform, by means for example of pressure welding, soldering, gluing, bending or pressing.

In the next step, an external source of fluid under pressure is connected to the valve element 7 through the supply duct 9 (see FIG. 1B). In this embodiment, the fluid is air, the source of fluid under pressure is a compressor, and the supply duct 9 together with the valve element 7 form a pneumatic connection. The type of the external source of fluid under pressure and of the connection equipment is not a limitation to the scope of this invention and in alternative embodiments it is possible to use fluid in the form of water, fluid cement, machine oil, fluid plastic such as a one-, two- or three-component foam (e.g. a flex 140 type), etc. together with the connection equipment and the source of fluid under pressure appropriate for those fluids. The less compressible the fluid is, the more controllable the deformation conditions of the I-profile preform are.

The next step of the I-profile manufacturing method according to the invention consists in placing the I-profile preform between the pressure plates so that the pressure plates are in contact with the I-profile preform flanges, as illustrated in FIG. 11. The pressure plates may be the working elements of a mechanical press. In this case, a controlled force may be applied to the pressure plates, particularly in the direction towards the I-profile preform.

In the subsequent step of the I-profile manufacturing method according to the present invention, a fluid under a defined pressure is delivered to the sealed inner space of the I-profile preform while keeping the I-profile preform between the pressure plates. The technology of introducing fluid under pressure into closed sealed chamber elements made of sheet metal for their deformation and providing them with the final form is known inter alia from patent application No. EP2110189A1. As a result of delivering a fluid under pressure into the inner space of the I-profile preform, the walls of the I-profile preform deform, with the greatest deformation level being located in the middle of the I-profile, in the web region, as best illustrated in FIG. 1C.

FIG. 2C schematically shows the cross-section of the I-profile manufactured from the I-profile preform. As can be observed, the first web wall 3 and the second web wall 4 of the I-profile preform are significantly deformed. Furthermore, the two inner walls 2 of the first flange and the two inner walls 6 of the second flange of the I-profile preform are also deformed. As a result, in the cross-section indicated in FIG. 1C, the I-profile manufactured from the preform of the invention and with the method of the invention has a shape resembling a lantern. By keeping the I-profile preform between the pressure plates of the press during the step of delivering fluid under pressure into the inner space of the I-profile preform, as illustrated in FIG. 11, it was possible to preserve a plane-parallel shape of the I-profile flanges, maintaining the functional characteristics of the I-profile thus manufactured.

Note should be taken that although the introduction of fluid under pressure into the inner space of the I-profile preform is performed in cold technology (i.e. in room temperature), it is not a limitation to the scope of this invention, and in alternative embodiments the process may be performed in elevated or high temperatures.

In one embodiment of the invention, the step of introducing fluid under pressure was performed with the following process parameters:

process temperature—20° C.,
working pressure—5 bars,
deformation time—1 minute until pressure is equalized in the I-profile preform,
pressure hold time—30 seconds,
total deformation time—1.5 minute.

EMBODIMENT 2

A further embodiment of the I-profile preform according to the invention is shown in FIG. 4A-H, in which further manufacturing, i.e. bending, steps of the I-profile preform are also illustrated.

In general, the I-profile preform is a structure substantially similar to the structure of the I-profile preform shown in the first embodiment, the difference being that the I-profile preform according to this embodiment is formed of a complete intermediate I-profile, and not of two E- and C-profiles matched with each other. The solution is advantageous in that a smaller number of longitudinal seals 8 needs to be made for hermetically closing the inner space of the I-profile preform.

The method for obtaining an I-profile preform according to this embodiment of the invention is schematically shown in successive steps in FIG. 4A-H. The method begins by providing a metal sheet with an installed valve element 7 and making a bend along a line (extending in the longitudinal direction of the I-profile preform) at an angle of 90° in the location indicated with the arrow in FIG. 4A. The formed shorter bend (as in FIG. 4B) will correspond to the second inner wall 2 of the first flange of the finished I-profile preform. In the subsequent step, two longitudinal bends are made along parallel lines at an angle of 90°, in locations indicated with the arrows in FIG. 4B. The shorter side of the formed intermediate product (shown in FIG. 4C) corresponds to the second web wall 4 with the installed valve element 7 of the finished I-profile preform. In the subsequent step, the second, longer bend is bent (in the location indicated with the arrow in FIG. 4C) at an angle of 90° in the direction opposite with respect to the previous bends, forming the outer wall 1 of the first flange of the finished I-profile preform. Another bend at an angle of 90° is made on the intermediate wall between the previous bends, in the location indicated with the arrow in FIG. 4D, for forming the first inner wall 2 of the first flange of the I-profile preform. In the subsequent step, the section of the intermediate product corresponding to the outer wall 1 of the first flange of the I-profile preform is bent at an angle of 90° in the direction opposite with respect to the previous bend for forming a lap which is the first inner wall 2 of the first flange and the outer wall 1 of the first flange of the finished I-profile preform, as illustrated in FIG. 4F. In the subsequent step, as illustrated in FIG. 4F, two bends are made in the intermediate region between the first web wall 3 and the second web wall 4, in locations indicated with the arrows. The bends are made inwards at an angle of 90° for forming an intermediate element shown in FIG. 4G and for defining the outer wall 5 of the second flange of the finished I-profile preform. In the subsequent step, two bends are made in the locations indicated with the arrows in FIG. 4G, wherein the bends are made by an angle of 90° inwards, for forming a finished complete intermediate I-profile being an I-profile preform, as illustrated in FIG. 4H.

Analogically to embodiment 1, the I-profile preform thus formed is sealed on all free edges, including on one longitudinal edge, for forming a leakproof hermetic inner space of the I-profile preform. Further manufacturing steps are similar to those presented in embodiment 1, and therefore they will not be repeated for the clarity of this disclosure.

EMBODIMENT 3

A further embodiment of the I-profile preform according to the invention is shown in FIG. 5A-G, in which further manufacturing steps, i.e. bending steps, of the I-profile preform are also illustrated.

In general, the I-profile preform is a structure substantially similar to the structure of the I-profile preform shown in the first and in the second embodiments, the difference being that the I-profile preform according to this embodiment is formed of an incomplete intermediate I-profile, and not of two E- and C-profiles matched with each other or of a complete intermediate I-profile. The solution is advantageous in that it is possible to use an outer wall 1 of the first flange of the I-profile preform having different technical characteristics, such as thickness and/or type of material, which translate into the functional characteristics of the manufactured I-profile.

The method for obtaining an I-profile preform according to this embodiment of the invention is schematically shown in successive steps in FIG. 5A-F. The method begins by providing a metal sheet with an installed valve element 7 (FIG. 5A) and making two bends along parallel lines (extending in the longitudinal direction of the I-profile preform) at an angle of 90° for obtaining an intermediate product shown FIG. 5B. The formed bends correspond to the inner walls 2 of the first flange of the finished I-profile preform. In the subsequent step, the intermediate product of FIG. 5B is bent along two bending lines, at an angle of 90°, in the same direction as the previous bends (FIG. 5C), for forming respectively the first web wall 3 and the second web wall 4 of the finished I-profile preform. In the subsequent step, as illustrated in FIG. 5D, two bends are made in the intermediate region between the first web wall 3 and the second web wall 4, in the direction opposite to the previous bends. The bends are made inwards at an angle of 90° for forming the inner walls 6 of the second flange and the outer wall 5 of the second flange of the finished I-profile preform. In the subsequent step (as illustrated in FIG. 5D), further bends are made along the lines of previous bends, by further 90°, in the same direction, for forming a lap corresponding to the second flange (i.e. the two inner walls 6 of the second flange and the outer wall 5 of the second flange) of the finished incomplete I-profile shown in FIG. 5E. In the subsequent step, the incomplete I-profile shown in FIG. 5E is matched with with the flat bar being the outer wall 1 of the first flange, thus forming a finished I-profile preform shown in FIG. 5F.

Analogically to embodiment 1, the I-profile preform thus formed is sealed (with seals 8) on all free edges, including on the two longitudinal edges (between the flat bar being the outer wall 1 of the first flange and the inner walls 2 of the first flange of the I-profile preform), as illustrated in FIG. 5F, for forming a leakproof hermetic inner space of the I-profile preform. Further manufacturing steps are similar to those presented in embodiment 1, and therefore they will not be repeated for the clarity of this disclosure.

FIG. 5G is an axonometric view of an I-profile preform according to this embodiment of the invention, prior to sealing the longitudinal edges and the front edges of the I-profile preform.

Alternatively, the step of introducing fluid into the hermetically closed inner space of the I-profile preform may be performed with the use of fluid concrete, as illustrated in FIG. 10A-B. After the fluid concrete under an appropriate pressure is introduced into the inner space of an I-profile preform, the first web wall 3 and the second web wall 4, as well as the first and the second inner wall 2 of the first flange and the first and the second inner wall 6 of the second flange, respectively, are deformed, as shown in the cross-section in FIG. 10B. After the concrete solidifies, the I-profile thus formed is a lost form (lost formwork).

EMBODIMENT 4

Another embodiment of the I-profile preform according to the invention is shown in FIG. 6A-C.

In general, the I-profile preform is a structure substantially similar to the structure of the I-profile preform shown in the third embodiment, the difference being that the I-profile preform according to this embodiment is formed of two C-profiles matched with their webs corresponding to each other, the webs being the first web wall 3 and the second web wall 4 of the I-profile preform, and of two flat bars being the outer wall 1 of the first flange and the outer wall 5 of the second flange of the I-profile preform, respectively. The solution is advantageous in that it is possible to use an outer wall 1 of the first flange and the outer wall 5 of the second flange of the I-profile preform having different technical characteristics, such as thickness and/or type of material, which translate into the functional characteristics of the manufactured I-profile.

FIG. 6A schematically shows the step of matching two C-profiles, with a valve element 7 being installed in the web of one them. Two C-profiles matched with their webs corresponding to each other are supplemented with two flat bars being the outer wall 1 of the first flange and the outer wall 5 of the second flange of the I-profile preform. In the subsequent step shown in FIG. 6B, the free edges of the components of the I-profile preform are sealed, the seals being provided in the form of seals 8 to the longitudinal edges between the flat bar being the outer wall 1 of the first flange and the upper flanges of the matched C-profiles and, respectively, between the flat bar being the outer wall 5 of the second flange and the lower flanges of the matched C-profiles, as is best illustrated in FIG. 8C.

FIG. 6C is an axonometric view of an I-profile preform according to this embodiment of the invention prior to sealing the longitudinal edges and the front edges of the preform.

EMBODIMENT 5

Further non-limiting embodiments of the I-profile preform are shown in an axonometric view in FIG. 7A-C, while FIG. 7D-F shows an axonometric view of I-profiles manufactured with the use of the I-profile preforms. Each illustrated I-profile preform and each illustrated I-profile manufactured with the use of the I-profile preforms is accompanied by the corresponding cross-sections, the cross-sections being drawn in the plane intersecting the I-profile in the middle, in the longitudinal direction. Each of the I-profile preforms shown in FIG. 7A-C may be built following any of the methods shown in embodiments 1-4.

In FIG. 7A, the I-profile preform comprises an upper flange and a lower flange, which assume a rectangular shape with the longitudinal edges parallel to each other, while FIG. 7D shows an I-profile manufactured from this preform.

In FIG. 7B, the upper flange and the lower flange of the I-profile preform assume a shape with concave longitudinal edges, resembling an hourglass shape, while FIG. 7F shows an I-profile manufactured from this preform.

In FIG. 7C, the upper flange and the lower flange of the I-profile preform assume a shape with convex longitudinal edges, resembling a barrel shape, while FIG. 7E shows an I-profile manufactured from this preform.

Further non-limiting embodiments of the I-profile preforms are shown in FIG. 8A-C. The illustrated I-profile preforms have a structure corresponding to the structure of the I-profile preform shown in embodiment 3, i.e. the structure in which the outer wall 1 of the first flange of the I-profile preform is a flat bar having a thickness greater than the walls forming the incomplete intermediate I-profile. However, the embodiments shown in FIG. 8A-C may be also realized with other I-profile preform structures disclosed herein.

As shown in FIG. 8A-C, the I-profile preforms may have individual flanges of different, symmetrical and asymmetrical widths, as well as webs of different heights. In the embodiment shown in FIG. 8A, the I-profile preform has its first (upper) flange of a width greater than the second (lower) flange. The I-profile preform shown in FIG. 8B has its first flange similarly of a width greater than the second flange, while the web height is greater than the web height of the I-profile preform shown in FIG. 8A. In turn, the I-profile preform shown in FIG. 8C has the web shorter than the web shown in FIG. 8B, while the second (lower) flange has a width greater than the first (upper) flange.

Further embodiments of the I-profile preform are shown in axonometric views in FIG. 9A-C. Each of the I-profile preforms shown in FIG. 9A-C may be built following any of the methods shown in embodiments 1-4. Embodiments of the I-profile preforms shown in FIG. 9A-C have different flange geometries, with FIG. 9A showing an I-profile preform which has the first (upper) flange assuming a rectangular shape of a first width and the second (lower) flange assuming a rectangular shape of a second width, smaller than the first width. FIG. 9B shows an I-profile preform which has the first (upper) flange assuming a barrel shape and the second (lower) flange assuming a rectangular shape. In turn, FIG. 9C shows an I-profile preform which has the first (upper) flange assuming an hourglass shape and the second (lower) flange assuming a rectangular shape of significant width.

EMBODIMENT 6

The I-profiles manufactured with the method according to the invention were subjected to comparative tests (based on numerical calculations) with standard I-profiles commonly used in the art. The results of the comparative tests are presented in Table 1. The tested I-profiles manufactured with the method of the invention were designated in Table 1 as IPEF and IPEF*. The IPEF I-profile is a profile manufactured entirely of sheet steel (the Young modulus of 207 GPa) 0.8 mm in thickness in such a way that each wall 1, 2, 3, 4, 5, 6 is sheet steel having an identical thickness of 0.8 mm, as shown in embodiment 1. The IPEF* I-profile is a profile manufactured of sheet steel (the Young modulus of 207 GPa) 1 mm in thickness, wherein the outer wall 1 of the upper flange and the outer wall 5 of the lower flange are flat bars of the same steel 3 mm in thickness, which corresponds to the I-profile manufactured from the I-profile preform built as in embodiment 4. The IPEF and IPEF* I-profiles, as well as the compared standard I-profiles (IPE 100, IPE AA 100, IPE AA 80) had a length L equal to 875 mm. Each of the compared I-profiles also had substantially identical (outer) geometric dimensions.

When comparing I-profiles of identical length and very similar mass, a significant increase in the rigidity of the FIDU I-profile can be observed in relation to the standard I-profile.

In turn, the IPEF* I-profile, with the outer wall 1 of the first flange and the outer wall 5 of the second flange being a flat bar 3 mm in thickness and with other walls 2, 3, 4, 6 being made of steel sheet 1 mm in thickness (resulting in a total mass of 4.19 kg) has an almost 20 times greater torsional rigidity SSK than the I-profile IPE AA 80 (having a mass of 4.26 kg). This is due to a significantly greater cross-sectional moment of inertia with a very similar cross-sectional area. When subjected to compression, the IPEF* I-profile has an insignificantly lower rigidity, which is due to the convex geometry. The IPEF* I-profile shows 6.5 times higher bending rigidity SZ due to a better distribution of the wall thicknesses in the profile and to greater volumetric dimensions while preserving a similar mass.

The IPEF I-profile is very prone to buckling W due to its non-uniform geometry and thin walls. The calculated critical force SK is 6.5 kN. On the other hand, the calculated critical force SK for the IPEF* I-profile is 75.6 kN. It is higher than the calculated critical force SK of the IPE AA 80 I-profile and insignificantly lower than the critical force SK of the IPE AA 100 I-profile, which has similar volumetric dimensions, but a greater mass.

TABLE 1 technical parameters of I-profiles

| | SSC [kN/mm] | SSK [Nm/°] | SZ lower point [kN/mm] | W SK [kN] | L [mm] | M MOD [kg] | M REAL [kg] |
|---|---|---|---|---|---|---|---|
| IPEF | 48.4 | 109.1 | 12.8 | 6.5 | 875 | 2.17 | |
| IPEF* | 118.6 | 214.9 | 55.6 | 75.6 | 875 | 4.19 | |
| IPE 100 | 240.2 | 38.5 | 21.4 | 105.2 | 875 | 6.94 | 7.09 |
| IPE AA 100 | 196.7 | 26 | 16.9 | 83 | 875 | 5.69 | 5.86 |
| IPE AA 80 | 147.5 | 11.5 | 8.5 | 45.4 | 875 | 4.26 | 4.29 |

The following reference symbols were used in the table:

SSC—calculated rigidity—compression

SSK—calculated rigidity—torsion

SZ—calculated rigidity—bending

W/SK—buckling/calculated critical force

L—length m—mass

MOD—from the model

REAL—actual

A comparison of the IPEF profile manufactured of sheet steel 0.8 mm in thickness to a standard I-profile IPE 100, which is of corresponding geometric dimensions, allows an observation that IPEF has an almost three times higher torsional rigidity SSK at 0.31 of the mass of IPE 100. It owes its higher torsional rigidity SSK to its spatial geometry, which has a greater resemblance to a closed profile. A significantly lower compressive rigidity SSC is the result of a lower mass, a smaller cross-sectional area of the IPEF profile, and a convex geometry. Lower bending rigidity SZ is also the result of a smaller cross-sectional area.

In comparison to a standard IPE AA 100 I-profile, the situation is similar. The SSK, SSC and SZ rigidities of the IPE AA 100 I-profile are lower than the SSK, SSC and SZ rigidities of the IPE 100 I-profile, because the IPE AA 100 I-profile has the flanges and the web of a smaller thickness.

The calculations were based on actual geometries of the IPEF and IPEF* profiles, while the geometries of the standard IPE profiles did not account for the imperfections, which could negatively influence the rigidity values SSK, SSC and SZ and the calculated critical force values SK. When identifying the rigidity of the bent I-profiles, consideration was given to points located in lower tensioned layers, in which local deformations from the applied forces did not occur.

LIST OF REFERENCE NUMERALS

1—outer wall of the first flange of the I-profile

2—inner wall of the first flange of the I-profile

3—first web wall of the I-profile

4—second web wall of the I-profile

5—outer wall of the second flange of the I-profile

6—inner wall of the second flange of the I-profile

7—valve element

8—seal

9—supply duct

The invention claimed is:

1. An I-profile preform comprising:

an outer wall of a first flange, and two inner walls of the first flange arranged in adjacent relation with respect to the outer wall of the first flange, a first web wall, wherein the first web wall extends perpendicular to the outer wall of the first flange, and a second web wall arranged in a plane parallel with respect to the first web wall, wherein the second web wall is disposed away from the first web wall in a direction perpendicular to the plane, an outer wall of a second flange, wherein the outer wall of the second flange extends perpendicular to the plane, and two inner walls of the second flange arranged in adjacent relation with respect to the outer wall of the second flange, wherein the walls are comprised of deformable sheet metal and are arranged in joined relation with respect to each other to provide in transverse cross section a fluidly sealed, closed empty I-shaped inner space within the I-profile preform, and a valve element, wherein the valve element is arranged on one of the walls and is configured to communicate sheet metal deforming fluid pressure to the inner space through the valve element.

2. The I-profile preform according to claim 1, wherein the two inner walls of the first flange are each arranged in one common plane that extends parallel to the outer wall of the first flange.

3. The I-profile preform according to claim 1, wherein the two inner walls of the second flange are each arranged in one common plane that extends parallel to the outer wall of the second flange.

4. The I-profile preform according to claim 1, wherein the outer wall of the first flange, one inner wall of the two inner walls of the first flange, the first web wall, one inner wall of the two inner walls of the second flange, and the outer wall of the second flange are all comprised of a single metal sheet, and in transverse cross section have an E-profile, and wherein the other inner wall of the two inner walls of the first flange, the second web wall, and the other inner wall of the two inner walls of the second flange are all comprised of a further single metal sheet, and in transverse cross section have a C-profile.

5. The I-profile according to claim 1, wherein one inner wall of the two inner walls of the first flange, the first web wall, one inner wall of the two inner walls of the second flange, the outer wall of the second flange, the other inner wall of the two inner walls of the second flange, the second web wall and the other inner wall of the two inner walls of the first flange are all comprised of a single metal sheet.

6. The I-profile according to claim 1, wherein at least one of one inner wall of the two inner walls of the first flange, the first web wall, and one inner wall of the two inner walls of the second flange are all comprised of a single metal sheet, and in transverse cross section have a C-profile, and the other inner wall of the two inner walls of the second flange, the second web wall, and the other inner wall of the two inner walls of the first flange are all comprised of a further single metal sheet, and in transverse cross section have a C-profile.

7. The I-profile preform according to claim 1, wherein a single metal sheet comprises all the walls.

8. The I-profile according to claim 1, wherein at least one of the outer wall of the first flange and the outer wall of the second flange comprise a flat bar.

9. The I-profile according to claim 1, wherein the plurality of walls include unconnected wall edges, wherein the unconnected wall edges are sealed with at least one seal, wherein the at least one seal bounds the fluidly sealed, closed empty I-shaped inner space.

10. The I-profile preform according to claim 9, wherein the at least one seal comprises a fusion weld, a pressure weld, a layer of adhesive or a lap joint.

11. The I-profile preform according to claim 1, wherein the first flange has a different transverse width than the second flange.

12. The I-profile preform according to claim 1, wherein the valve element includes a pneumatic or hydraulic connection.

13. The I-profile preform according to claim 1, wherein the valve element is arranged on the first web wall or the second web wall.

14. An I-profile preform comprising:

an outer wall of a first flange, and two inner walls of the first flange arranged in adjacent relation with respect to the outer wall of the first flange, a first web wall, wherein the first web wall extends perpendicular to the outer wall of the first flange, and a second web wall arranged in a plane parallel with respect to the first web wall, an outer wall of a second flange, wherein the outer wall of the second flange extends perpendicular to the plane, two inner walls of the second flange arranged in adjacent relation with respect to the outer wall of the second flange, wherein the walls are comprised of deformable sheet metal and are arranged in joined relation with respect to each other to provide in transverse cross-section a fluidly sealed closed empty inner space within the I-profile preform, and a valve element, wherein the valve element is arranged on one of the walls and is configured to enable fluid communication with the inner space through the valve element, wherein the walls of the first flange and/or the walls of the second flange, define at least one of a barrel shape and an hourglass shape in a longitudinal direction, wherein the longitudinal direction extends parallel to the plane.

15. An I-profile preform comprising:

a first flange, wherein the first flange includes a first flange outer wall, and two first flange inner walls, a second flange, wherein the second flange is disposed away from the first flange and includes a second flange outer wall, and two second flange inner walls, a first web wall, wherein the first web wall extends perpendicular to each of the first flange outer wall and the second flange outer wall, and is engaged with one of the first flange inner walls and with one of the second flange inner walls, a second web wall, wherein the second web wall extends parallel to the first web wall, is engaged with the other of the first flange inner walls and with the other of the second flange inner walls, wherein the first flange, the second flange, the first web wall and the second web wall in transverse cross-section bound a hermetically sealed closed empty I-shaped inner space within the preform, wherein at least the first web wall, the second web wall, the two first flange inner walls and the two second flange inner walls are comprised of at least one deformable metal sheet, a fluid connector, wherein the fluid connector is configured to communicate metal sheet deforming fluid pressure to the inner space.

16. A method comprising:

a) providing an I-profile preform including:

an outer wall of the first flange, and two inner walls of the first flange arranged in adjacent relation with respect to the outer wall of the first flange, a first web wall, wherein the first web wall extends perpendicular to the outer wall of the first flange, and a second web wall, wherein the second web wall extends in a plane parallel with respect to the first web wall, an outer wall of the second flange, wherein the outer wall of the second flange extends perpendicular to the plane, two inner walls of the second flange arranged in adjacent relation with respect to the outer wall of the second flange, wherein the walls are comprised of deformable sheet metal and are arranged with respect to each other to provide a closed empty inner space within the I-profile preform, and wherein the walls of the I-profile preform have at least one unconnected wall edge, a valve element, wherein the valve element extends on one of the walls and is configured to enable fluid communication with the inner space through the valve element, b) sealing the at least one unconnected wall edge, wherein the closed empty inner space is hermetically sealed, c) operatively connecting a source of fluid pressure with the valve element, d) inserting the I-profile preform between pressure plates, wherein the pressure plates are in operative contact with the first flange and the second flange, e) subsequent to (b), (c) and (d), introducing fluid under pressure from the source into the inner space.

17. The method according to claim 16, wherein in (b) the sealing includes fusion welding, pressure welding, gluing or crimping.

18. The method according to claim 16, wherein in (e) the fluid comprises air, machine oil, water, fluid concrete or fluid plastic.

19. The method according to claim 16, wherein during at least a portion of (e) a force is applied by the pressure plates to each of the first flange and the second flange in a direction parallel to the plane.

20. The method according to claim 16, wherein (e) is carried out at room temperature or at a temperature higher than room temperature.

21. The method according to claim 16, wherein in (e) the pressure of the fluid in the inner space is at least 5 bars.

22. The method according to claim 16, wherein in (e) the fluid under pressure is introduced into the inner space for 1 minute, and subsequently a constant pressure is maintained in the inner space for 30 seconds.

* * * * *